US009079091B2

(12) United States Patent
Lewis et al.

(10) Patent No.: US 9,079,091 B2
(45) Date of Patent: Jul. 14, 2015

(54) SPORTS GLOVE RAPID REMOVAL SYSTEM

(71) Applicants: Jerry Glenn Lewis, San Diego, CA (US); Martin Ernest Adler, San Diego, CA (US)

(72) Inventors: Jerry Glenn Lewis, San Diego, CA (US); Martin Ernest Adler, San Diego, CA (US)

( * ) Notice: Subject to any disclaimer, the term of this patent is extended or adjusted under 35 U.S.C. 154(b) by 106 days.

(21) Appl. No.: 13/956,316

(22) Filed: Jul. 31, 2013

(65) Prior Publication Data

US 2015/0033440 A1 Feb. 5, 2015

(51) Int. Cl.
*A41D 19/00* (2006.01)
*A63B 71/14* (2006.01)

(52) U.S. Cl.
CPC ..... *A63B 71/141* (2013.01); *A41D 19/0017* (2013.01)

(58) Field of Classification Search
CPC ..... A63B 71/148; A41D 19/01582; A41D 19/0034; A41D 19/0017
USPC ..... 2/159, 161.1, 161.2, 163, 160
See application file for complete search history.

(56) References Cited

U.S. PATENT DOCUMENTS

| | | | | | |
|---|---|---|---|---|---|
| 822,868 | A * | 6/1906 | Pribil et al. | 27/21.1 |
| 1,329,073 | A * | 1/1920 | Czicziriga | 441/57 |
| 3,023,432 | A * | 3/1962 | Loomis | 441/57 |
| 3,231,910 | A * | 2/1966 | Tegland | 441/57 |
| 3,930,271 | A * | 1/1976 | Kahng | 2/161.4 |
| 4,058,863 | A * | 11/1977 | Ferdico | 441/57 |
| 4,368,883 | A * | 1/1983 | Tiktin | 482/105 |
| 4,371,983 | A * | 2/1983 | Piotti, Jr. | 2/19 |
| 4,548,588 | A * | 10/1985 | Kosuge | 441/57 |
| 4,669,991 | A * | 6/1987 | Southworth | 441/57 |
| 4,923,418 | A * | 5/1990 | Hoffman | 441/57 |
| 5,004,227 | A * | 4/1991 | Hoffman | 482/105 |
| 5,224,220 | A * | 7/1993 | Andriola | 2/160 |
| 5,276,922 | A * | 1/1994 | Floyd, Jr. | 2/160 |
| 5,468,200 | A * | 11/1995 | Hoffman | 482/55 |
| 5,608,912 | A * | 3/1997 | Cumberland | 2/16 |
| 5,641,316 | A * | 6/1997 | Bakalis | 441/57 |
| 5,675,839 | A * | 10/1997 | Gordon et al. | 2/159 |
| 5,768,711 | A * | 6/1998 | Wissink | 2/161.1 |
| 5,820,526 | A * | 10/1998 | Hoffman | 482/55 |
| 5,924,136 | A * | 7/1999 | Ogean | 2/159 |
| 6,341,376 | B1 * | 1/2002 | Smerdon, Jr. | 2/16 |
| 7,210,172 | B2 * | 5/2007 | Adams, Jr. | 2/163 |
| D611,227 | S * | 3/2010 | Fryda et al. | D2/617 |
| 8,790,224 | B1 * | 7/2014 | Davis | 482/111 |

* cited by examiner

*Primary Examiner* — Danny Worrell

(57) ABSTRACT

A sports glove rapid removal system wherein all five adjacent finger sheaths are encircled by independent loops of the size and location to be convenient for four fingers of the opposite hand to grasp and to pull to remove the glove. The system is designed to apply removal force comprehensively to the glove rather than to individual parts of the glove. Specifically, the pulling force exerted by the four fingers of the opposite hand is directed by the loop system to the entire body of the glove, rather than just the finger sheaths, resulting in the force being distributed as necessary to ease removal of the glove. A particular characteristic of the system is its utilization of four removal loops simultaneously, including the thumb and index finger loop, to align the thumb with the other fingers, and thereby reduce the gathering of glove fabric that can cause resistance at the thumb and other finger joints.

1 Claim, 3 Drawing Sheets

FIG. 4
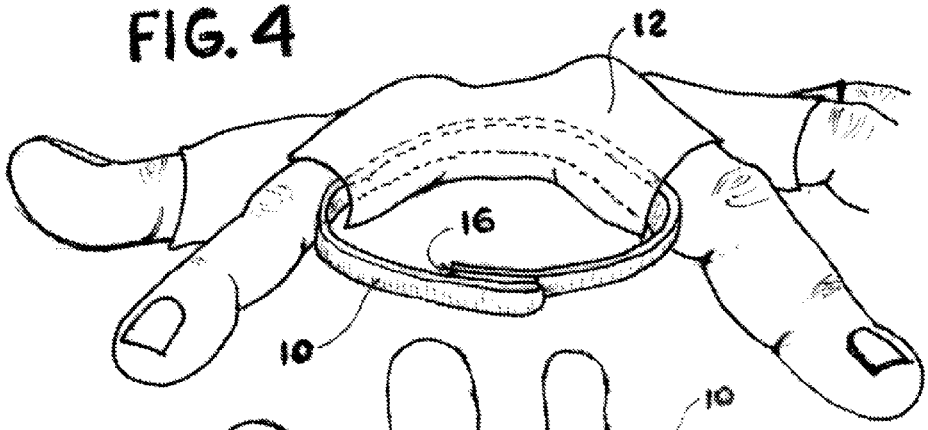
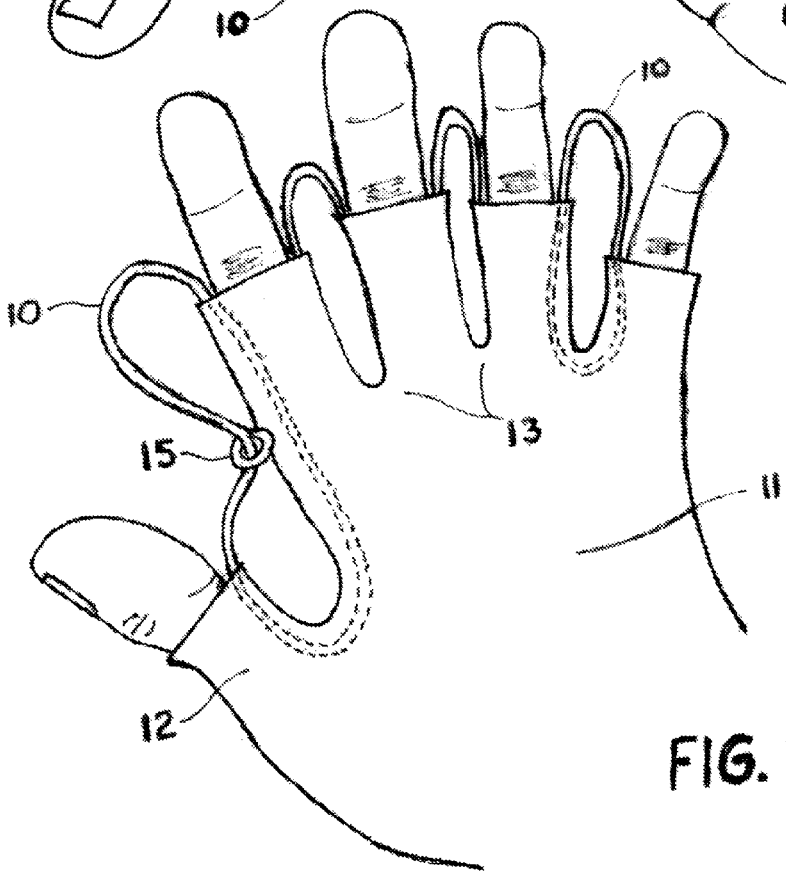
FIG. 3

SPORTS GLOVE RAPID REMOVAL SYSTEM

CROSS-REFERENCE TO RELATED APPLICATIONS

Not Applicable

BACKGROUND OF THE INVENTION

The invention relates to a system for the removal of partial-fingered sheath gloves, with increased speed and ease. These sports gloves, as they are known, are widely used by athletes, but also find use in various professions for their comfort and protective characteristics. The invention eliminates a common complaint of wearers, the difficulty of glove removal.

A feature of the type of sports gloves described above is that the fingers of the gloves, or sheaths, extend from the knuckles up to the middle of the wearer's fingers. In addition, such glove sheaths are usually designed to fit snugly around the wearer's fingers to facilitate the gripping of objects.

A major complaint of sports glove wearers is the difficulty of removal. Common methods of removal are an iterative process of pulling and tugging at the individual sheaths or peeling the glove off inside-out. The thumb sheath, because of its angle to the other fingers, is often the most difficult to remove.

Prior art has offered several ways to enhance removal. U.S. Pat. No. 5,004,227 described an exercise glove which connected four of the longest finger sheaths with loops for facilitating removal. However, this prior art did not provide a solution to a major problem encountered by wearers, removability of the glove over the distal thumb joints.

U.S. Pat. No. 5,768,711 proposed a glove with tabs on each finger sheath, including the thumb. However, the method of removal was sequentially grasping and urging the tabs outward, one finger at a time.

U.S. Pat. No. 5,675,839 proposed a glove with tabs or loops attached to the backs of the finger sheaths for glove removal. However, the force of removal was directed by the tabs or loops to the finger sheaths rather than to the body of the glove. Because the gloves are flexible, directing the force of removal to the finger sheaths frequently results in a gathering of fabric at the finger joints, and with that configuration the fingers of the opposite hand push against the walls of the finger sheaths interfering with removal.

U.S. Pat. No. 5,820,526 proposed gloves with 3 loops, in the written specification, in at least one embodiment, with the loops going through adjacent finger sheaths. However, the fourth loop that should have encircled the area between the thumb and the index finger sheaths was neither described nor claimed by the inventor.

Based on the limitations of the prior art, a more comprehensive solution was needed which would address removal of the whole body of the glove, including all five of the fingers' sheaths, all at one time, with speed and ease.

SUMMARY OF THE INVENTION

The subject invention provides a system of loops between all five finger sheaths of a partial-fingered sports glove to spread the force of removal across the body of the glove, resulting in glove removal being quicker and easier. A particular advantage of the invention is its utilization of the four removal loops simultaneously, including using the thumb and index finger loop to bring the thumb in parallel with the other fingers, thus solving the common problem not solved by the prior art, difficulty in removing the thumb sheath. The invention has a further advantage that it can be either incorporated into the glove during glove manufacture or it can be added as an accessory to an existing glove.

BRIEF DESCRIPTION OF THE DRAWINGS

FIG. 3 is a palm view of a glove illustrating an embodiment of the invention in which the thumb and index finger loop is routed through a ring attached to the base of the index finger sheath, to aid in aligning the thumb axis with the other fingers.

FIG. 4 is a view of the loop between the index finger and the middle finger illustrating how a loop can be adapted to an existing glove as an accessory.

DETAILED DESCRIPTION OF THE PREFERRED EMBODIMENTS

With reference to FIGS. 1, 2, 3, and 4, the sports glove rapid removal system of the present invention is shown and designated in various configurations as 10. The invention, which is a system of loops, is designed to direct forces to the glove body at the most effective locations for rapid and easy glove removal. It can be used on any partial-fingered sheath glove, illustrated by glove 11, which is removed by extracting each finger from the glove in the direction parallel to its respective sheath 12. A partial-fingered sheath glove for the purpose of this invention leaves a distal portion of each of the fingers exposed when the glove is being worn. It is understood that although the drawings illustrate the invention used in conjunction with a left-handed glove, the invention can be similarly configured on a right-handed glove.

Figure 1:
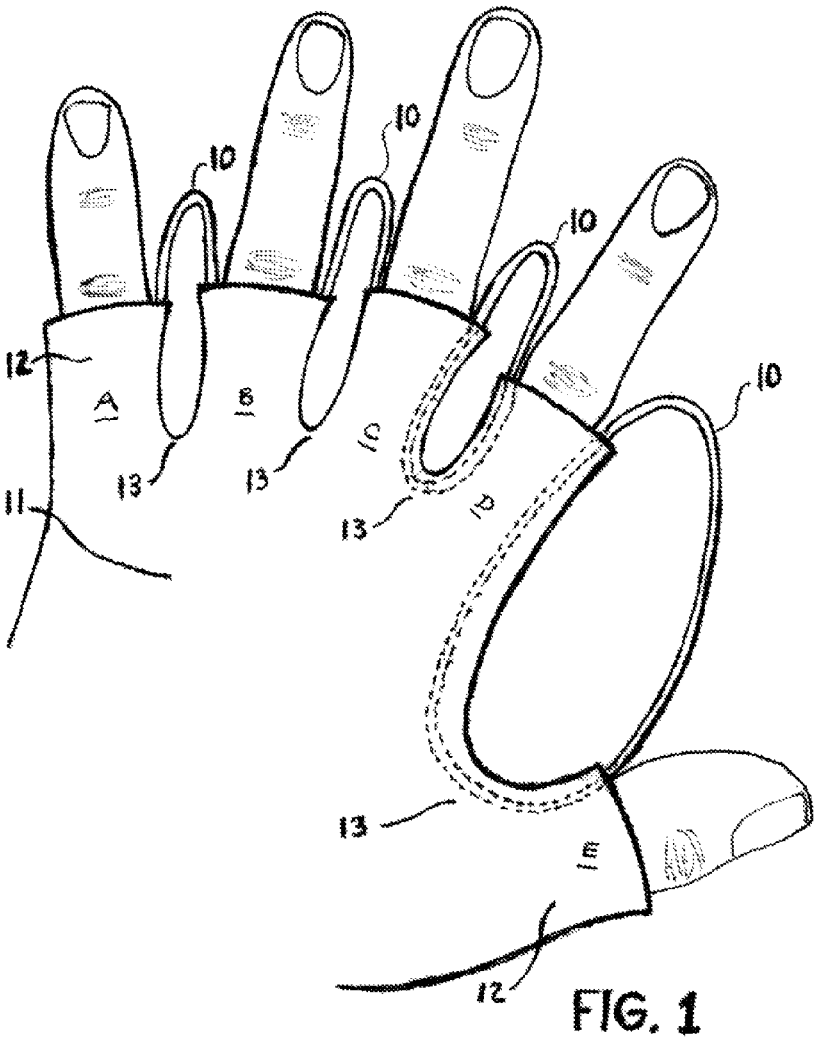
FIG. 1 is a backhand view of a partial-fingered sheath glove on a user's hand illustrating how the rapid removal loop system is installed on the glove.

In the preferred embodiment shown in FIG. 1, the rapid removal loop system is independent of the design of the portion of the glove surrounding the palm, though the glove must be removable by extracting it over the distal portions of the fingers which is the purpose of the present invention. The invention may be added to the glove during manufacturing of the glove or may be independently added by the glove user as an accessory to facilitate glove removal.

Figure 2:
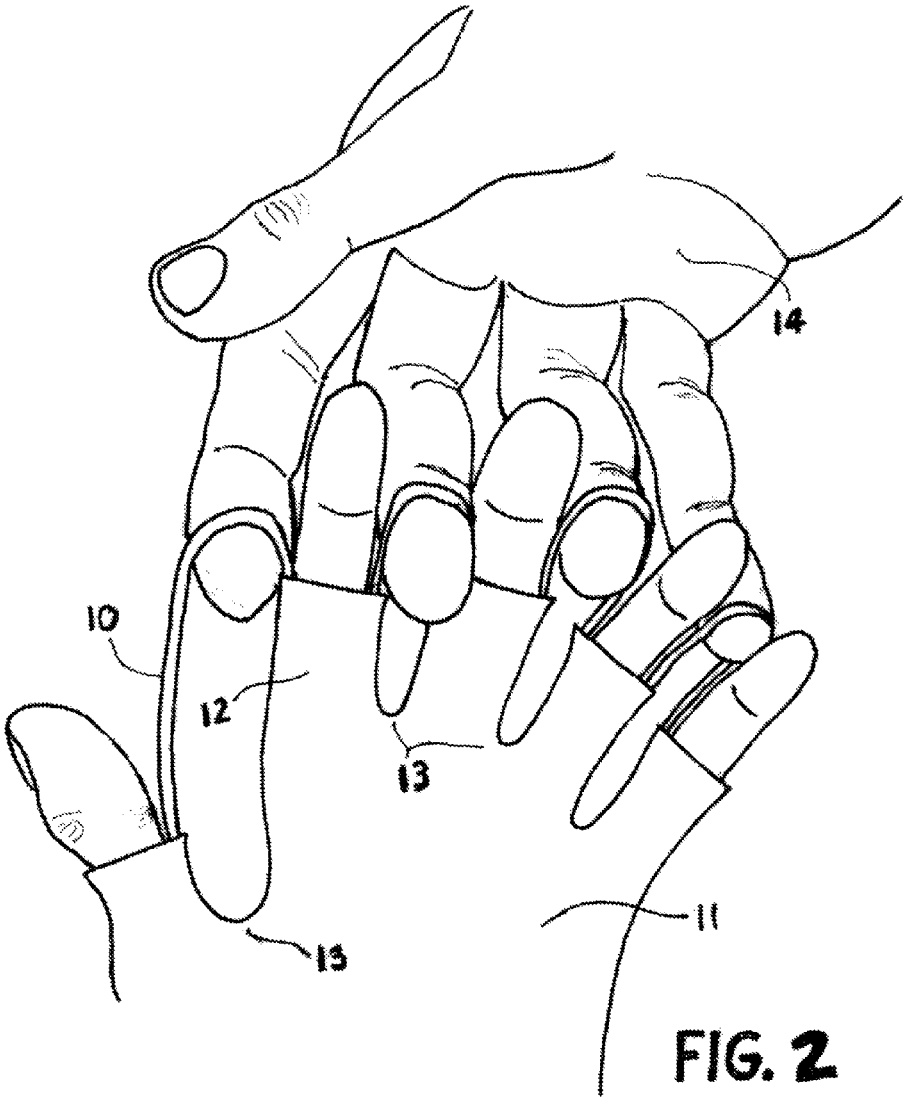
FIG. 2 is a palm view of the removal loop system in FIG. 1 illustrating how four fingers of the opposite hand grasp the loops, including the thumb loop, for glove removal.

As seen in FIGS. 1, 2, and 3, all five adjacent finger sheaths A,B,C,D,E, are encircled by independent loops 10, the size and location to be convenient for fingers of the opposite hand to grasp and remove the glove. The loops may be physically attached to the glove at the U-shaped areas 13 at the base of the fingers or not. Either embodiment, attached or unattached, achieves the purpose of transferring the removal force from the fingers of the other hand 14 through the loops 10, primarily to the body of the glove 11 rather than to the sheaths.

The specific technique for utilizing the invention is shown in FIG. 2 where four fingers of the opposite hand 14 each engage a corresponding loop 10 of the invention worn on the gloved hand and proceed to pull the glove 11 off the hand. When the present invention is utilized, the direction of the removal force on the glove body and all five finger sheaths is parallel to the finger that each sheath covers, and all fingers are pointed in the same general direction, including the thumb.

The preferred embodiment uses all four loops as a system, which includes the thumb loop, to facilitate glove removal. It is the utilization of all four loops that gives the invention one particular advantage over prior art. With conventional gloves, lacking the present invention, the thumb sheath is often the most difficult to remove due to the relatively large size of the distal joint of the thumb and the greater angle of the thumb to the other fingers when all fingers are extended radial from the palm. The present invention solves that problem by directing the force exerted on the glove body during removal in an axial direction to all fingers, including the thumb. By this alignment, the resistance of the thumb joint and the other finger joints to sheath and glove body removal is effectively reduced.

The use of all four loops, including the thumb loop, is a distinguishing feature of the present invention, and the use of the thumb loop in particular is an important and necessary feature of the invention, The thumb loop which is routed through the thumb sheath and the adjacent index finger sheath, when pulled by the opposite hand for removal, moves the thumb to the easiest position for glove removal, parallel to the index finger.

The invention is distinguished from other glove removal accessories in several ways. First, the four loops are constructed and positioned on the glove to transfer the entire necessary pulling force of four fingers of the opposite hand, shown in FIG. 2, to the four U-shaped areas 13 at the base of the adjoining sheaths as shown in FIGS. 1, 2, and 3. Thus, the force is directed at the entire body of the glove which is pulled distally to the hand rather than pulling only on one or more of the sheaths as may be practiced by other removal systems.

Because of the lack of a systematic application of forces to the glove body, the prior art often resulted in a gathering of the glove fabric adjacent to the finger joints, resulting in a resistance to removal. With the invention, the fingers of the opposite hand naturally adjust the force among the four loops to spread the force over the width of the glove body to achieve removal without gathering of the sheath fabric. The result is a more rapid and much easier removal of the glove.

In addition, when the loops of the sports glove removal loop system are pulled axially to the fingers for removal of the glove, the loops slightly open the finger sheaths, which are usually made of flexible fabric, to aid in removal because the loop material has been routed through the inside of each sheath, parallel to the sheath wall FIGS. 1, 3 and 4.

The removal loops which are utilized in this invention may be produced from various materials of construction, including synthetic or natural fibers as used in clothing. Elastic bands or non-elastic ribbons of approximately 0.25 cm. (0.1 inch) to 2.0 cm. (0.8 inch) width are usable, though 0.6 cm. (0.25 inch) in width is preferred. The length of the loops and the thickness of the fabric can be tailored to the specific glove, considering comfort and strength. The fabric of the loops is chosen to be soft and flexible enough not to cause irritation to the wearer's hand, flexible so that they are easy to move out of the way of the fingers or obstacles being gripped, and preferably washable and water-repellent. However, the fabric must be strong enough to withstand the axial pulling force exerted for glove removal and to have enough structure to maintain the general shape of a loop for easy grasping by the fingers of the other hand. The cross-sectional area of the loops can be varied to fit comfortably into the finger sheaths, while providing enough surface area to be comfortable to the fingers engaged in pulling on the loops during glove removal.

Many materials of construction meet these criteria, including commercially-available multi-fold bias tape, flat-profile shoe strings, and the elastic tape commonly used in clothing. Bias tape of the dimensions 0.6 cm. (0.25 inch) wide, by approximately 15 cm. to 20 cm. (6 to 8 inches) long, depending on the particular fit with the finger sheath, by approximately 0.1 cm. (0.05 inch) thick, for each loop is an example of one material successfully used in prototype testing of the invention.

Since the purpose of this invention is to facilitate removal of the sports glove, and the thumb is often the most difficult finger to remove because of the large distal thumb joint of some glove users, one embodiment of the invention is to direct the thumb loop through a small ring or similar device attached to the index finger sheath as shown in FIG. 3. When the loops are pulled for glove removal, the thumb is pulled over next to the adjacent index finger, in parallel with it, and thereby reduces the resistance of the thumb joint to glove removal. Since the hole in the ring is larger than the diameter of the loop fabric passing through it, the loop fabric can move through the ring in either direction. Therefore, the loop does not interfere with the full extensor movement of the thumb during normal use of the glove.

If attaching the loops 10 to the body of the glove at the U-shaped area 13 is desired, any standard method and form of attachment, such as sewing the proximal end of the loop to the glove, is appropriate as long as the attaching mechanism doesn't irritate or limit the fingers or interfere with normal use of the glove.

The loops can be continuous such as cutting the material of construction in an elliptical pattern for inclusion of the loops in the glove during manufacture. The loops can be cut from the same pattern as the main body of the glove if the pattern has been modified to include elliptical loops at the proper locations 13. Or the loops as in FIG. 5 can be open-ended to use as an accessory on gloves that were made without the invention. In that embodiment, the end of the loops can be passed through the adjacent sheaths and connected by a suitable means such as hook-and-loop 16, VELCRO™ for example, or sewing, or fabric glue.

An extremely adjustable loop can be made by cutting out a ribbon comprised of hook-and-loop fabrics, approximately half of the ribbon being hook and the other half loop. When added as an accessory, the two ribbons are hook-and-loop connected on each end to form a complete loop through the adjacent finger sheaths. If too long or too short for interlocking with the fingers of the other hand, the hook-and-loop fabric can be shortened or elongated by unhooking and rehooking the ends at a different position on the ribbons.

What is claimed is:

1. A rapid removal sports glove for a hand, the glove comprising:

a glove body having a palm panel for covering a palm of the hand connected to a back panel for covering a back of the hand, a partial thumb sheath for partially covering a thumb of the hand, a partial index sheath for partially covering an index finger of the hand, a partial middle sheath for partially covering a middle finger of the hand, a partial ring sheath for partially covering a ring finger of the hand and a partial pinky sheath for partially covering a pinky finger of the hand, the partial sheaths each having a respective base portion;

four individual U-shaped sections forming a connection between the base portions of each adjacent partial sheath;

four individual elliptical-shaped loops of fabric, each loop of fabric individually routed within and confined by a respective one of the U-shaped sections between the adjacent finger sheaths;

a small ring portion attached to the base of the partial index sheath, wherein the individual elliptical shaped loop of fabric between the partial thumb sheath and the partial index sheath is additionally routed through the small ring for directly and easily pulling the partial thumb sheath into parallel alignment with the partial index sheath upon glove removal, connection means for connecting the individual loops of fabric to the glove at the respective U-shaped areas of the glove body without attaching to any other area of the glove;

said loops of fabric are either continuous uninterrupted loops or are formed of two open ends of fabric attachable to one another via sewing, hook and loop or similar connection means thus forming the complete loop of fabric;

wherein the loops of fabric are formed from materials consisting of: non-synthetic fabrics, synthetic fabrics, elastic fabrics, hook and loop fabric, leather or combinations thereof;

wherein the fabrics are of a predetermined strength and flexibility to withstand the removal of the glove and allow movement during glove usage.

* * * * *